US005350346A

United States Patent [19]

Martinez

[11] Patent Number: 5,350,346

[45] Date of Patent: Sep. 27, 1994

[54] WEIGHT BENCH WITH SLIDABLE SEAT CONSTRUCTION

[75] Inventor: Guillermo Martinez, Miami, Fla.

[73] Assignee: Legacy International, Inc., Florida, N.Y.

[21] Appl. No.: 93,822

[22] Filed: Jul. 20, 1993

[51] Int. Cl.[5] ..... A63B 21/00

[52] U.S. Cl. ..... 482/142; 482/104

[58] Field of Search ..... 482/104, 133, 142, 908

[56] References Cited

U.S. PATENT DOCUMENTS

| | | | |
|---|---|---|---|
| D. 326,696 | 6/1992 | Bogaczyk et al. . | |
| D. 330,238 | 10/1992 | Desiderio . | |
| 4,396,191 | 8/1983 | Metler | 482/104 |
| 4,546,968 | 10/1985 | Silberman . | |
| 4,598,908 | 7/1986 | Morgan . | |
| 4,635,934 | 1/1987 | Boethke | 482/104 |
| 4,641,837 | 2/1987 | Ruth | 482/104 |
| 4,653,751 | 3/1987 | Green | 482/104 |
| 4,720,099 | 1/1988 | Carlson | 482/142 X |
| 4,746,114 | 5/1988 | Grider | 482/104 |
| 4,749,190 | 6/1988 | Jennings . | |
| 4,765,616 | 8/1988 | Wolff | 482/104 |
| 4,793,608 | 12/1988 | Mahnke et al. | 482/142 X |
| 4,936,572 | 6/1990 | Desiderio | 482/104 |
| 4,958,833 | 9/1990 | Slater . | |
| 5,011,141 | 4/1991 | Towley, III et al. . | |
| 5,082,259 | 1/1992 | Gonzalez | 482/104 X |
| 5,141,480 | 8/1992 | Lennox et al. . | |
| 5,160,305 | 11/1992 | Lin . | |

FOREIGN PATENT DOCUMENTS

| | | | |
|---|---|---|---|
| 208208 | 1/1987 | European Pat. Off. | 482/104 |
| 2065482 | 7/1981 | United Kingdom | 482/104 |
| 2106399 | 4/1983 | United Kingdom | 482/142 |

*Primary Examiner*—Robert Bahr
*Attorney, Agent, or Firm*—Frank P. Presta

[57] ABSTRACT

A weight bench having a slidable seat construction includes a two piece slidable bench which is pivotally connected to the frame of a weight bench. A sleeve, designed to travel along a frame member, supports the seat portion of the bench at a pivotal attachment and by an angle adjusting bracket mechanism. A back rest portion of the bench is pivotally attached at one end thereof to the sleeve. The other end is connected to the frame by a support which is pivotally attached to both to the frame and the underside of the back rest portion. The sleeve is lockable in a given position along the length of the frame member providing support therefor. Sliding movement of the bench produces simultaneous adjustment of the inclination of the back rest due to the double pivotal attachment of the support. The sliding seat assembly is particularly adapted for weight benches having uprights with barbell supports.

13 Claims, 4 Drawing Sheets

WEIGHT BENCH WITH SLIDABLE SEAT CONSTRUCTION

FIELD OF THE INVENTION

The present invention is directed to a weight bench and, in particular, to a slidable bench assembly which provides both longitudinal and angular bench adjustment.

BACKGROUND ART

In the prior art, various types of weight benches with ancillary devices have been proposed to facilitate different types of weight lifting exercises. Typically, the weight bench includes a frame with upstanding legs to support a barbell. The frame also includes a bench to support an exerciser and, optionally, a removable leg lift unit.

The prior art has also proposed various adjustable bench assemblies to provide flexibility for the types of exercises adaptable for a given weight bench. U.S. Pat. No. 4,765,616 to Wolff discloses an adjustable workout bench including a laterally extending frame member that supports a bench. The back rest of the bench is supported by a cross member extending between the upstanding legs of the weight bench.

U.S. Pat. No. 4,936,572 to Desiderio teaches a seat support bracket for an exercising bench comprising a pivotally mounted inverted U-shaped bracket serving as a prop beneath the front of a bench press seat and movable through a pivotal traverse.

U.S. Pat. No. 4,653,751 to Green teaches a heavy duty multi-function exercise bench providing a manually operable, double adjustable, reversible, tiltable and sliding seat configuration. The seat includes a dual foam seat construction and manually operable angled locking pins for adjusting certain benchseat positions.

Drawbacks associated with these types of prior art weight benches include cumbersome or difficult adjustment features. For example, when an exerciser wishes to change to a different exercise routine, the tedious adjustment required for prior art weight benches interrupts the exercise routine.

In response to these deficiencies in prior art weight benches, a need has developed to provide an improved weight bench which provides a more flexible and efficient construction for adjustment of weight bench components, in particular, the weight bench seat. The present invention provides an improved weight bench with a slidable bench assembly overcoming the aforementioned disadvantages in the prior art.

SUMMARY OF THE INVENTION

It is a first object of the present invention to provide an improved slidable bench assembly for a weight bench.

Another object of the present invention is to provide an improved slidable bench assembly having improved adjustment features to facilitate bench adjustment for various exercise routines.

Other objects and advantages of the present invention will be apparent as the description thereof proceeds.

In satisfaction of the foregoing objects and advantages, there is provided a slidable bench assembly for a weight bench having a frame and supporting structure for various exercise devices. The slidable bench assembly comprises an elongated bench support member, a sleeve sized to longitudinally translate along the elongated bench support member, and a bench having a back rest and a seat. The back rest includes a first supporting frame with the seat including a second supporting frame, each of the back rest and the seat being pivotally attached to the sleeve at a respective end thereof. The assembly also includes a back rest support, the back rest support pivotally attached at one end thereof to a portion of the frame of the weight bench and pivotally attached at the other end thereof to the first supporting frame. Longitudinal translation of the sleeve causes pivotal movement of the back rest support with respect to the portion of the frame and the first supporting frame and angular adjustment of the back rest with respect to the elongated bench support member.

BRIEF DESCRIPTION OF DRAWINGS

Reference is now made to the drawings accompanying the invention wherein.

DESCRIPTION OF THE PREFERRED EMBODIMENTS

The present invention provides improvements over prior art weight benches with adjustable bench assemblies. Using the adjustable bench assembly of the present invention, an exerciser can more easily adjust the bench without complicated and tedious manipulation of adjusting components. For example, sliding the seat bench simultaneously adjusts the angulation of the back rest portion.

Figure 1:
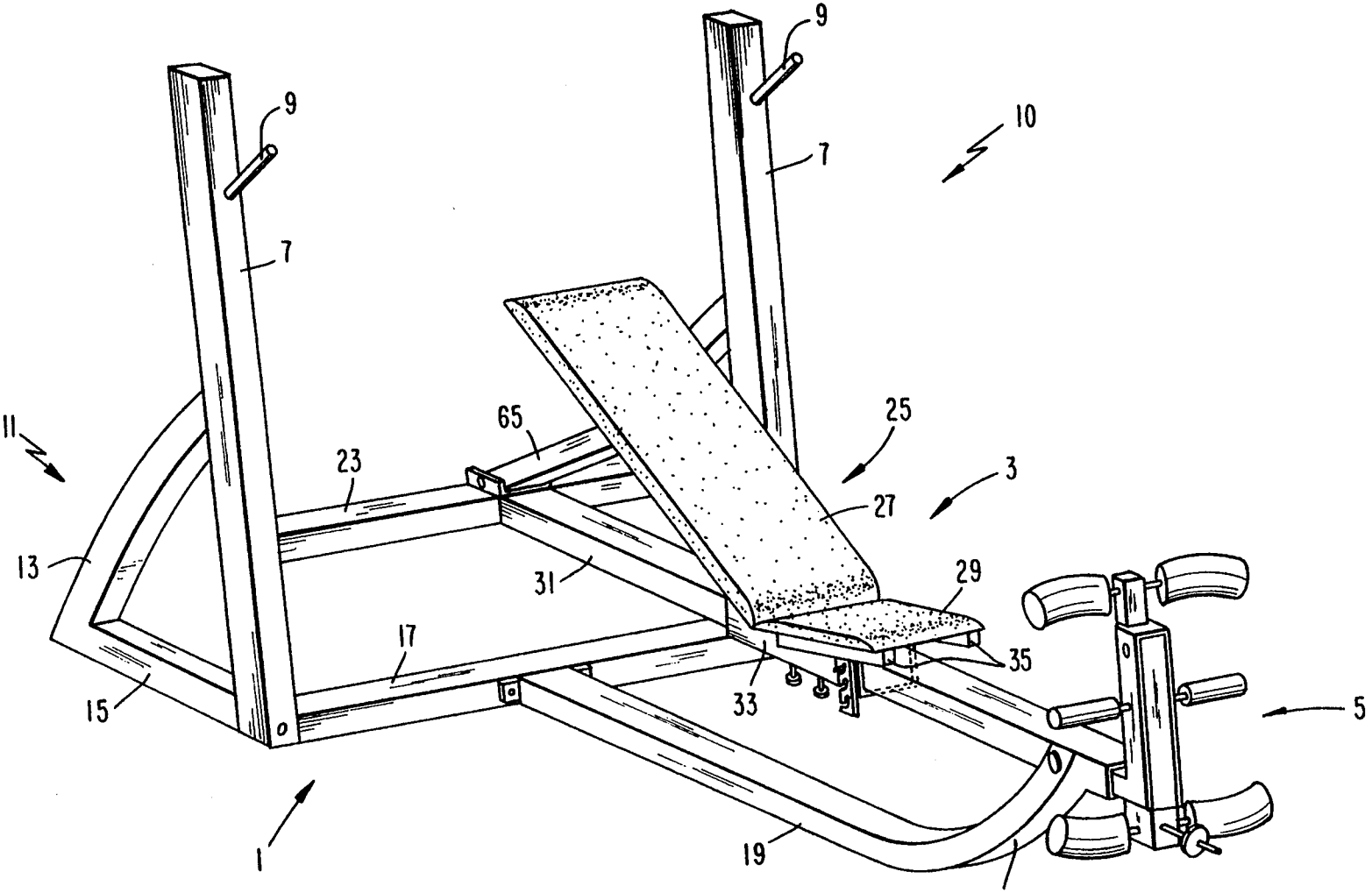
FIG. 1 is a perspective view of a weight bench showing the inventive sliding bench construction.

With reference now to FIG. 1, the present invention is generally designated by the reference numeral 10 and is seen to include a frame 1, sliding bench assembly 3 and a removable leg lift unit 5. Since the removable leg lift unit 5 is not an aspect of the present invention, further description is not deemed necessary.

The frame 1 includes uprights 7 and barbell rests 9. Although stationary barbell rests are depicted, any known type, including adjustable types, may be used with the uprights 7. The frame 1 also includes supports 11 comprising arcuate members 13 and base members 15. The supports 11 provide stability for the frame 1 as well as additional support for each of the uprights 7.

The frame 1 also includes a base member 17 disposed between the bottom of the uprights 7 and a cross member 23. A base member 19 extends generally perpendicular from the base member 17 and terminates in a curved portion 21. The removable leg lift unit 5 connects to the curved portion 21.

The slidable bench assembly has a separate two piece bench construction including a back rest 27 and a seat 29. Support for the bench is provided by support member 31 which extends between the cross member 23 and curved base portion 21.

Figure 2:
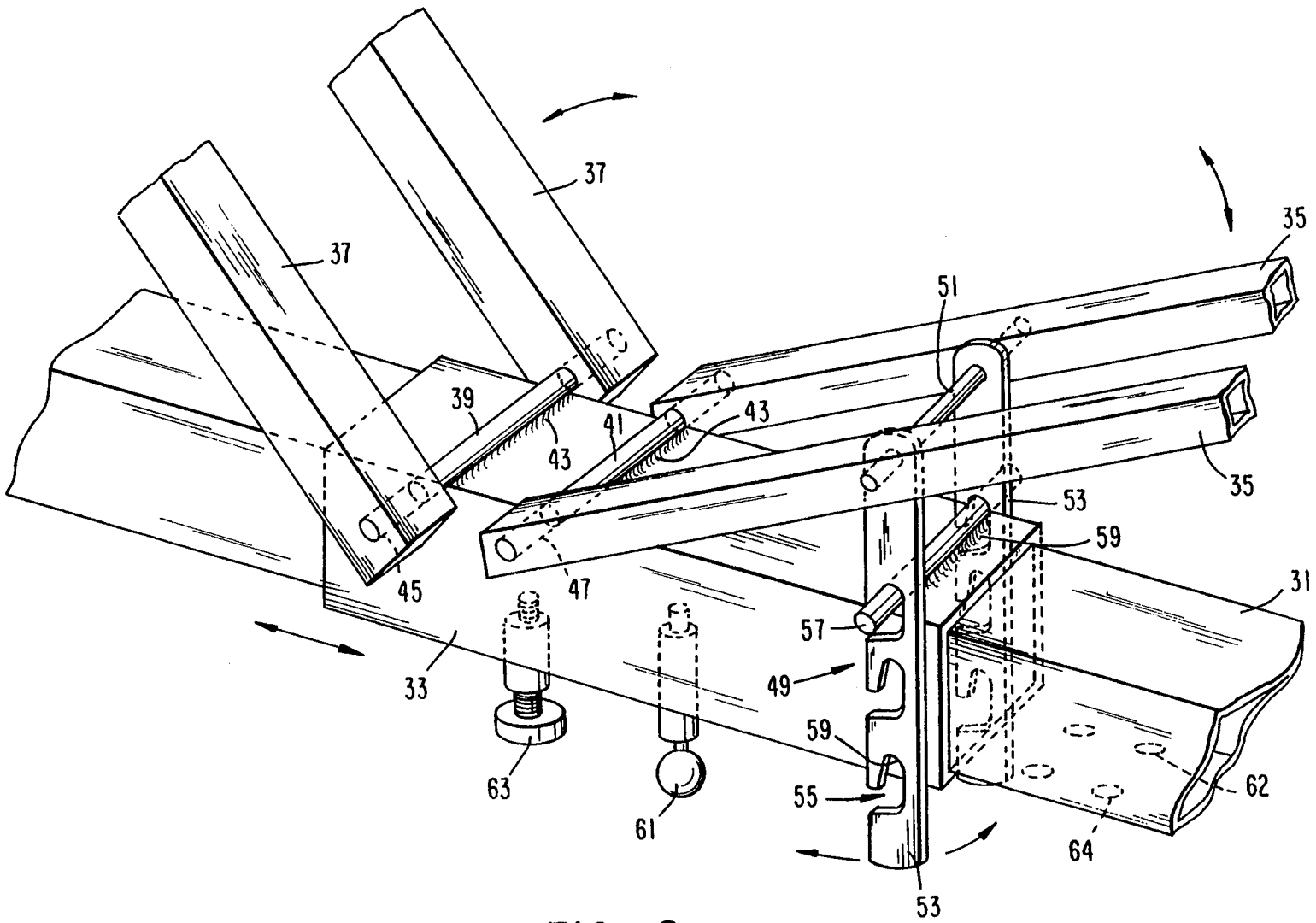
FIG. 2 is a perspective view of a portion of the sliding bench construction depicted in FIG. 1, enlarged to show greater detail.

With reference now to FIGS. 1 and 2, the seat 29 is supported by a pair of elongated frame members 35 with the back rest 27 being supported by elongated frame members 37. It should be understood that the back rest and seat have conventional type padded construction and may be attached to the elongated frame members in any known manner, for example, by fasteners or the like.

A sleeve 33, sized to longitudinally translate along support 31, provides support for the seat 29 and a portion of the back rest 27.

With particular reference to FIG. 2, the sleeve 33 has elongated rods 39 and 41 attached thereto. The method of attachment is shown as a weldment 43, but other known attaching methods may be used. The rod 39 is designed to engage through holes 45 in the frame members 37 to permit pivoting action of the back rest 27. Likewise, the rod 41 engages through holes 47 in the frame members 35 for pivoting action of the seat 29.

The frame members 35 may be secured in place to the rod 41 by attachment of the frame members 35 to the seat 29. In this manner of attachment, the frame members would be first attached to the rod 41 followed by attachment of the seat 29 to the frame members 35. Alternatively, other known fastening means may be used to secure the frame members 35 in place when mounted on the rod 41. Likewise, the same types of attachment may be used to secure the frame members 37 to the rod 39.

The seat is also supported by the support bracket assembly 49. This assembly includes a rod 51 disposed between the frame members 35. Pivotally attached to the rod 51 are a pair of brackets 53 which are secured in place by any known fastening means, e.g. a cotter pin. Each of the brackets 53 include a plurality of slots 55 along a length thereof. The slots 55 are designed to engage a rod 57 secured to the sleeve 33 via weldment 59. Again, the rod 57 can be secured to the sleeve 33 using other conventional fastening means.

In operation, the seat 29 is adjusted angularly with respect to the support 31 such that the rod 57 can enter one of the slots 55. The slot upper face 59 and rests on the rod 57 to support the frame members 35 and bench 29. Various inclinations can be achieved depending on the particular slot selected.

The sleeve 31 is secured to the support 31 by spring loaded locking mechanism 61 and threaded locking mechanism 53. A pin or screw of each of these mechanisms is designed to protrude through an opening in the sleeve 33 and a corresponding and aligned opening in the support 31. Preferably, the spring loaded locking pin mechanism 61 is arranged on the sleeve 33 to engage one of a plurality of openings 62 aligned longitudinally along the sleeve 33 (not shown) and the support 31. Offset from the through openings 62 are a plurality of longitudinally aligned openings 64 designed to threadably engage the screw of the threaded screw mechanism 63. By offsetting the openings 62 and 64, a greater number of openings may be provided on the sleeve 33 and support 31 to provide a greater number of positions for locking the sleeve 33 along the support 31. Of course, the mechanism 61 and 63 and their respective holes may both be aligned along the same longitudinal axis with respect to the sleeve 33 and support 31. Alternatively, the through holes 62 and 64 shown in FIG. 2 aligned in a transverse direction with respect to the sleeve 33 and support 31 may also be offset transversely from each other.

Figure 3:
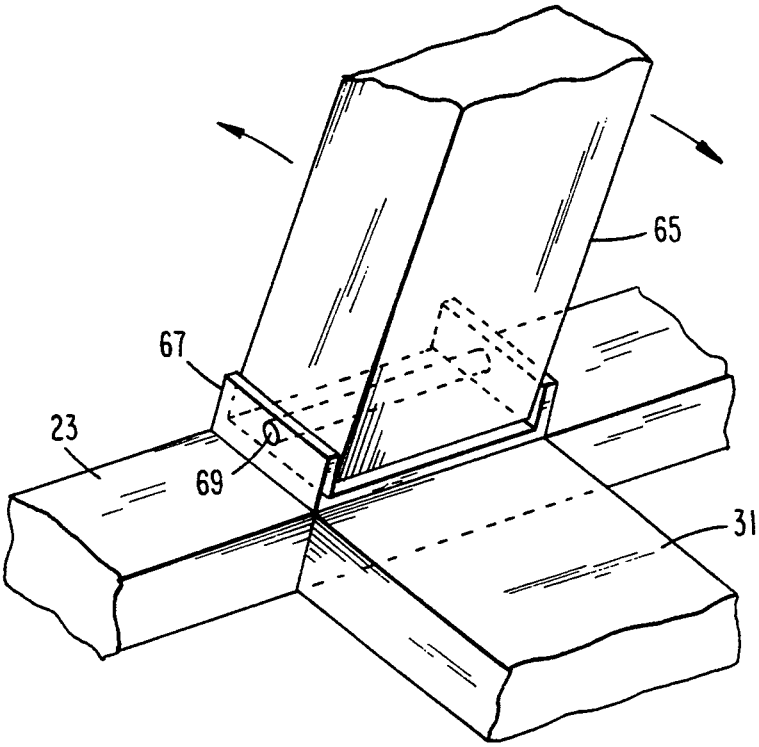
FIG. 3 is a perspective view of another portion of the sliding bench construction of FIG. 1, enlarged to show greater detail.

With reference now to FIGS. 1 and 3, the back rest 27 is also supported by a support 65. The support 65 is secured to the cross member 23 by a U-bracket 67 attached thereto and a pivoting pin or rod 69. With this arrangement, the support 65 can pivot in either direction depending on the sliding movement of the sleeve 33 and bench 25. The U-bracket 67 may be secured to the cross member 23 in any known conventional fashion.

Figure 4A:
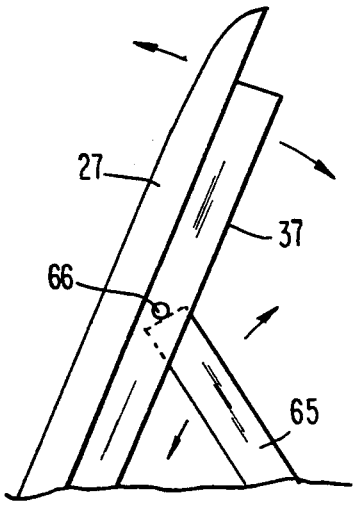
FIGS. 4A and 4B are rear and side views of the upper pivoting connection of the back rest of the sliding seat.
Figure 4B:
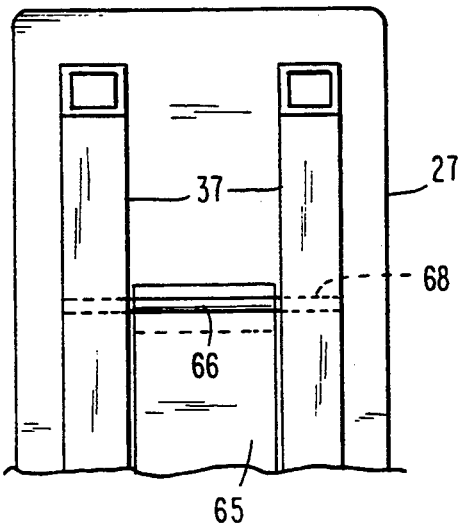

With reference to FIGS. 4A and 4B, the end of the support 65 opposite the U-bracket 67 is secured between frame members 37. Preferably, a pivot rod 66 is welded to an end face of the support 65, ends thereof engaging through holes 68 in the frame members 37. As described above, the rod 66 may be secured to the frame members initially followed by attachment of the back rest 27 or use of other fastening means. Alternatively, cotter pins or the like can be used to maintain the frame members 37 in position on the rod 66. In this embodiment, the ends of the rod 66 would extend beyond the frame members 37 and include a through hole for engagement by a cotter pin. Likewise, pins 39 and 41 may be modified for the use of cotter pins to maintain engagement with the frame members 35 and 37, respectively. Although the rod 66 is shown welded to support 65, the rod may engage a through hole in the support to achieve pivoting movement.

The double pivoting attachment of the support 65 between the frame member 23 and back rest 27 allows for angular adjustment of the back rest 27 by sliding movement of the sleeve 33. Thus, no separate adjusting steps are required to position the back rest in a given inclination.

Figure 5A:
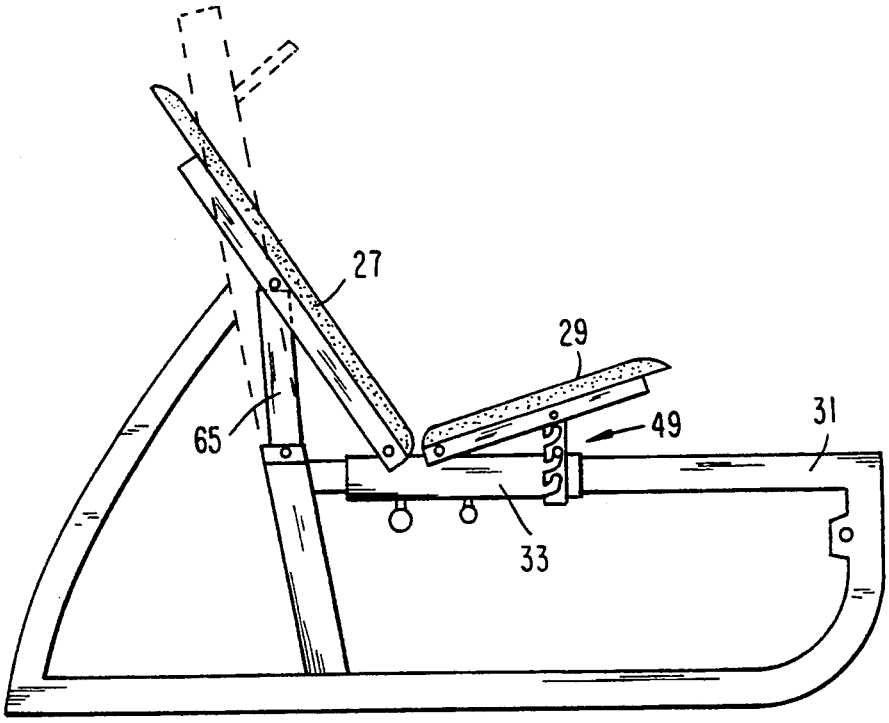
FIGS. 5A and 5B are side views of the weight bench with sliding seat construction showing alternative exercise positions.
Figure 5B:
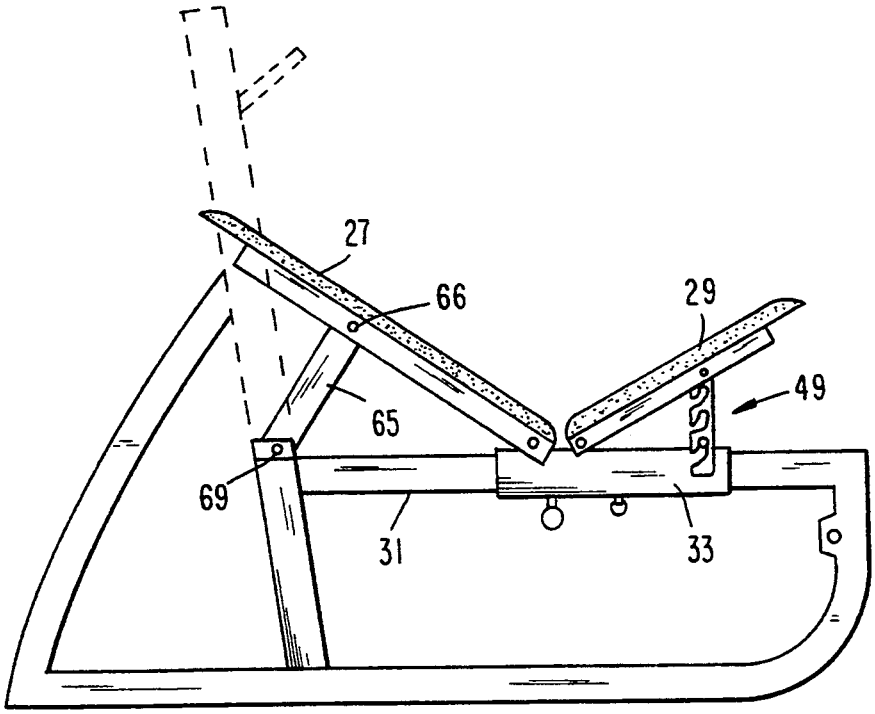

As can be seen from FIGS. 5A and 5B, the inventive sliding bench assembly provides improved adjustability with respect to a weight bench. The weight bench depicted in these figures has the removable leg lift unit removed and the upright 7 shown in phantom to show greater detail. In FIG. 5A, the sleeve 33 is translated near the cross member 23 and locked in place such that the back rest 27 has a relatively steep angle of inclination with respect to the support member 31. In this figure, the seat 29 is adjusted on the middle slot of the support bracket assembly 49.

In FIG. 5B, the sleeve 33 is translated away from the cross member 23 and locked in place. This movement pivots the support 65 about rods 66 and 69 to position the back rest at a lower angle of inclination. The seat 29 is shown in the uppermost raised position via the support bracket assembly 49. The sliding seat assembly provides a wide degree of adjustment with respect to the angulation of the back rest 27 and seat 29. Moreover, the adjustment of the back rest is easily achieved by the positioning of the sleeve 33 with respect to the support 31. No further adjustments of pins or other locking mechanism are required for the back rest.

The frame and other support components of the inventive weight bench with sliding bench assembly can have any configuration, with a preferred configuration being square or rectangular. Preferably, the various frame members have a hollow construction to minimize cost and weight. The sliding seat construction, although depicted with a particular weight bench design, may be used in any weight bench employing a horizontally disposed support member for the weight bench.

As such, an invention has been disclosed in terms of preferred embodiments thereof which fulfill each and everyone of the objects of the present invention as set forth hereinabove and provides a new and improved weight bench having a slidable seat construction.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. In a weight bench comprising a frame having means for supporting exercise devices, the improvement comprising a) an elongated bench support member;

b) a sleeve sized to longitudinally translate along said elongated bench support member;

c) a bench having a back rest and a seat, said back rest including a first supporting frame and said seat including a second supporting frame, each of said back rest and said seat being pivotally attached to said sleeve at a respective end thereof; and d) a back rest support assembly comprising:

i) a back rest support member having first and second ends; and ii) a mounting bracket fixed to a portion said frame at an intersection of said portion and one end of said elongated bench support member;

iii) an end face of said first end positioned within said mounting bracket with said first end pivotally attached to said mounting bracket;

iv) said second end of said back rest support member pivotally attached to said first supporting frame;

e) wherein longitudinal translational of said sleeve causes said back rest support member first end to pivot within said mounting bracket and said back rest support member second end to pivot with respect to said first supporting frame.

2. The weight bench of claim 1 further comprising a first means for locking said sleeve in place on said elongated bench support member and a second means spaced from said first means for further locking said sleeve in place on said elongated bench support member.

3. The weight bench of claim 2 wherein said first means for locking said sleeve includes a plurality of first holes in said elongated bench support member, said first locking means engaging one of said first holes when aligned with respect to said sleeve and said elongated support member.

4. The weight bench of claim 3 wherein said second means for locking said sleeve includes a plurality of second holes in said elongated bench support member, said second locking means engaging one of second holes when aligned with respect to said sleeve and said elongated support member.

5. The weight bench of claim 4 wherein said plurality of first holes are aligned longitudinally along said elongated bench support member and said plurality of second holes are aligned longitudinally along said bench support member, said first holes being spaced apart transversely from said second holes.

6. The weight bench of claim 5 wherein said first locking means is a spring loaded locking pin mounted to said sleeve and said second locking means includes a threaded screw mounted to said sleeve for threadable engagement with a threaded hole in said elongated bench support member.

7. The weight bench of claim 1 further comprising an adjustable bracket mounted to said second supporting member, said adjustable bracket including a plurality of slots, and a pin attached to said sleeve, said pin engaging one of said slots to support said seat in an inclined position.

8. The weight bench of claim 1 further comprising:

i) a first rod attached to said sleeve;

ii) first through holes on said first supporting frame engaging said rod so as to provide said pivotal attachment of said back rest to said sleeve;

iii) a second rod spaced from said first rod and attached to said sleeve; and iv) second through holes in said second supporting frame engaging said second rod so as to provide said pivotal attachment of said seat to said sleeve.

9. The weight bench of claim 8 wherein said first supporting frame and said second supporting frame each further comprise a pair of elongated channels mounted to a respective said back rest or seat.

10. The weight bench of claim 9 wherein one end of each said elongated channel mounted to said back rest includes said first through holes with the other end of each of said elongated channels being pivotally attached to said back rest support.

11. The weight bench of claim 10 wherein one end of each said elongated channel mounted to said seat includes said second through holes.

12. The weight bench of claim 11 further comprising an adjustable bracket mounted to said second supporting member, said adjustable bracket including a plurality of slots, and a pin attached to said sleeve, said pin engaging one of said slots to support said seat in an inclined position.

13. The weight bench of claim 1 wherein said first supporting frame and said second supporting frame each further comprise a pair of elongated channels mounted to a respective said back rest or seat.

* * * * *